US005959582A

United States Patent [19]

Kawahata et al.

[11] Patent Number: 5,959,582

[45] Date of Patent: Sep. 28, 1999

[54] SURFACE MOUNT TYPE ANTENNA AND COMMUNICATION APPARATUS

[75] Inventors: Kazunari Kawahata; Ken Okada, both of Kyoto, Japan

[73] Assignee: Murata MAnufacturing Co., Ltd., Japan

[21] Appl. No.: 08/980,717

[22] Filed: Dec. 1, 1997

[30] Foreign Application Priority Data

Dec. 10, 1996 [JP] Japan ..... 8-329484

[51] Int. Cl.[6] ..... H01Q 1/36

[52] U.S. Cl. ..... 343/700 MS; 343/846

[58] Field of Search ..... 343/700 MS, 702, 343/829, 846, 848, 749, 767; H01Q 1/24, 1/36

[56] References Cited

U.S. PATENT DOCUMENTS 5,442,366 8/1995 Sanford ..... 343/700 MS 5,537,123 7/1996 Mandai et al. ..... 343/700 MS 5,581,262 12/1996 Kawahata et al. ..... 343/700 MS 5,696,517 12/1997 Kawahata et al. ..... 343/700 MS 5,760,746 6/1998 Kawahata ..... 343/700 MS

*Primary Examiner*—Don Wong

*Assistant Examiner*—Tho Phan

*Attorney, Agent, or Firm*—Ostrolenk, Faber, Gerb & Soffen, LLP

[57] ABSTRACT

To reduce the manufacturing cost by reducing the number of surfaces of a dielectric base on which various patterns are formed, and to improve the ease of impedance matching while avoiding an increase in size. Each of a feed electrode and a ground electrode is formed between a position on an end surface and a position on a lower surface of a dielectric base. A radiation electrode is formed, which extends from a position on an upper surface to positions on the upper and lower surfaces via another end surface of the dielectric base.

16 Claims, 6 Drawing Sheets

FIG. 1
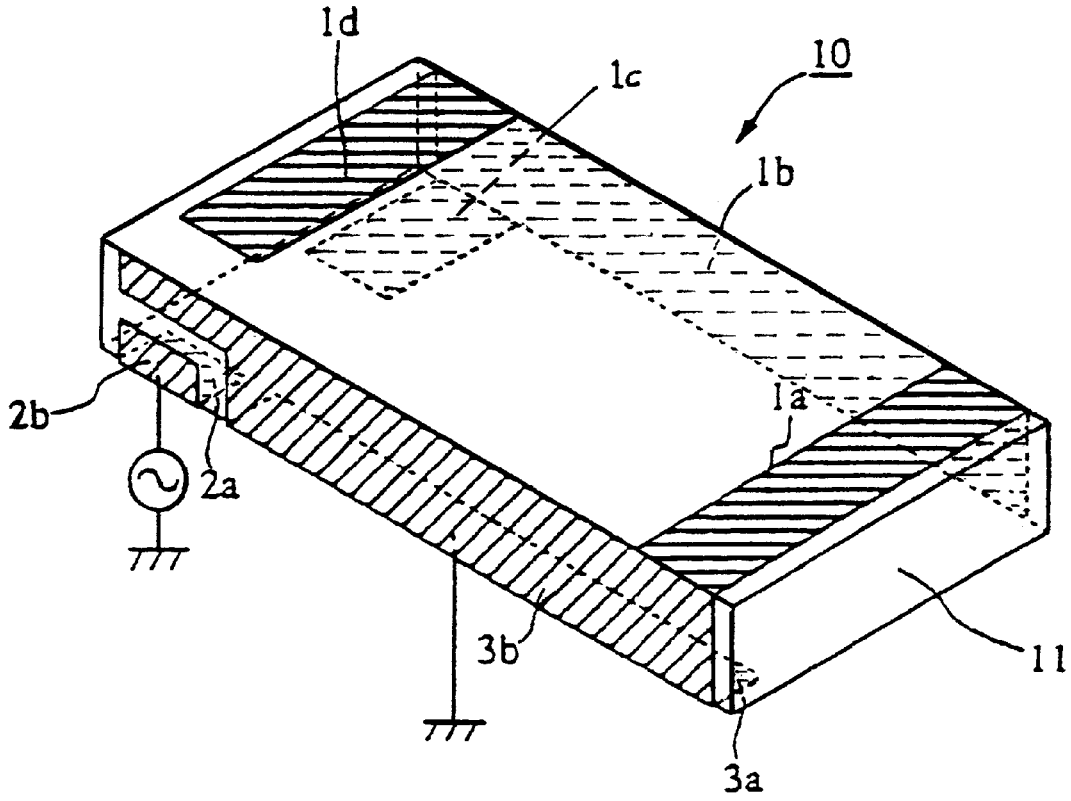
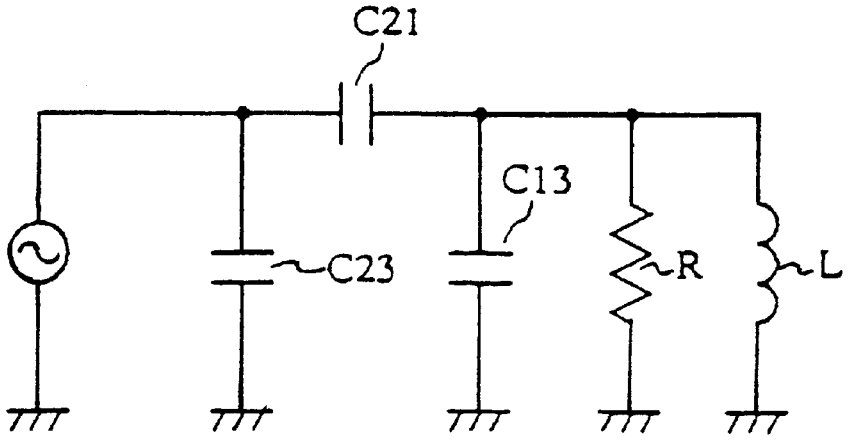
FIG. 2

SURFACE MOUNT TYPE ANTENNA AND COMMUNICATION APPARATUS

BACKGROUND OF THE INVENTION

1. Field of the Invention

The invention relates to a surface mount type antenna. More particularly, the invention relates to a surface mount type antenna comprising a dielectric/magnetic base having first and second main surfaces opposite from each other and side surfaces substantially perpendicular to the main surfaces, a feed electrode disposed on the base, a ground electrode disposed on the base, and a radiation electrode disposed on the base and having an open-circuited end capacitively coupled to the feed electrode and a short-circuited end connected to the ground electrode. The surface mount type antenna is used for mobile communication apparatus and a communication apparatus using the antenna.

2. Related Art

FIG. 7 shows a prior art antenna apparatus. A member 11 shown in the figure is a dielectric base. Electrodes 22*b*, 23*b*, 21*a*, 21*b* and 21*c* are formed on side surfaces of the dielectric base 11. Electrodes 22*a* and 23*a* are formed on the lower main surface as viewed in the figure. In these electrodes, the electrodes 22*a*, 22*b* function as a feed electrode, the electrodes 23*a*, 23*b* function as a ground electrode, and the electrodes 21*a*, 21*b*, 21*c* function as a radiation electrode. An electrostatic capacitance is thereby formed between an open-circuited end of the radiation electrode (an end portion of the electrode 21*c*) and the feed electrode 22*a*, 22*b*. The radiation electrode is excited by the capacitive coupling through this electrostatic capacitance. Thus, the surface mount type antenna functions as a resonating type antenna.

The conventional surface mount type antenna shown in FIG. 7, however, has the problems that it entails an increased number of electrode forming steps because of the need to form electrodes over many side surfaces of the dielectric base.

The radiation electrode formation surfaces of the conventional surface mount type antenna shown in FIG. 7 may be modified to solve this problem. For example, as shown in FIG. 8, the radiation electrode indicated by 21*a*, 21*b*, and 21*c* are formed on the upper main surface and the right rear end surfaces of the dielectric base 11 as viewed in the figure. In this structure, the electrostatic capacitance produced at the gap between the open-circuited end of the radiation electrode (an end portion of the electrode 21*c*) and the ground electrode 23*b* can be increased and a predetermined resonant frequency can be set even if the inductance of the radiation electrode is small. Advantageously, therefore, the overall size can easily be reduced. However, since the end of the ground electrode 23*b* is positioned between the feed electrode 22*a*, 22*b* and the open-circuited end of the radiation electrode, the coupling between the feed electrode and the radiation electrode is reduced, resulting in a reduction in the ease of impedance matching to an external circuit.

SUMMARY OF THE INVENTION

An object of this invention is to provide a surface mount type antenna in which the number of side surfaces on the dielectric base on which various electrode patterns are formed is reduced to reduce the manufacturing cost, and which is arranged so that each of the distance between a radiation electrode open-circuited end and a ground electrode and the distance between a radiation electrode open-circuited end and a feed electrode can easily be adjusted.

Another object of this invention is to provide a surface mount type antenna arranged so that the above-mentioned impedance matching can easily be performed while an increase in overall size is avoided.

The invention provides a surface mount type antenna of the above mentioned kind, wherein the open-circuited end of the radiation electrode is capacitively coupled to the feed electrode by extending the radiation electrode to both of the first and second main surfaces.

This structure makes it possible to increase the electrostatic capacitance between the radiation electrode open-circuited ends and the ground electrode and to easily increase the amount of coupling between the radiation electrode open-circuited ends and the feed electrode, thereby facilitating impedance matching. Also, the electrode formation area on the side surfaces of the dielectric base is not increased and the advantage of high workability in adjusting the frequency by cutting a portion of the radiation electrode can be maintained.

In the above surface mount type antenna, the radiation electrode may have at least two the short-circuited ends.

By this structure, the radiation electrode can be connected to the another circuit and/or an electronic component, for example. When at least one of the short-circuited ends is selectively connected or disconnected to ground via a resonant frequency control changing circuit, it is possible to change the resonant frequency of the antenna by changing the connection between the short-circuited end of the radiation electrode and the resonant frequency control changing circuit.

In the above surface mount type antenna, at least a part of the radiation electrode may be loop shape connected to one of the short-circuited ends.

In this structure, the loop functions as an electric wall and is equivalent in function to a radiation electrode formed over the entire area surrounded by the loop, thereby making it possible to increase the antenna gain.

Another aspect of the invention provides a communication apparatus comprising a circuit board having electrodes thereon and the above described surface mount type antenna mounted on the circuit board and connected to the electrodes.

This construction reduces the overall size and facilities impedance matching. As a result, the ease of circuit design of the transmitting and receiving circuit section can be improved.

BRIEF DESCRIPTION OF THE DRAWINGS

FIG. 1 is a perspective view of a surface mount type antenna which represents a first embodiment of the invention.

FIG. 2 is an equivalent circuit diagram of the surface mount type antenna of FIG. 1.

Figure 3:
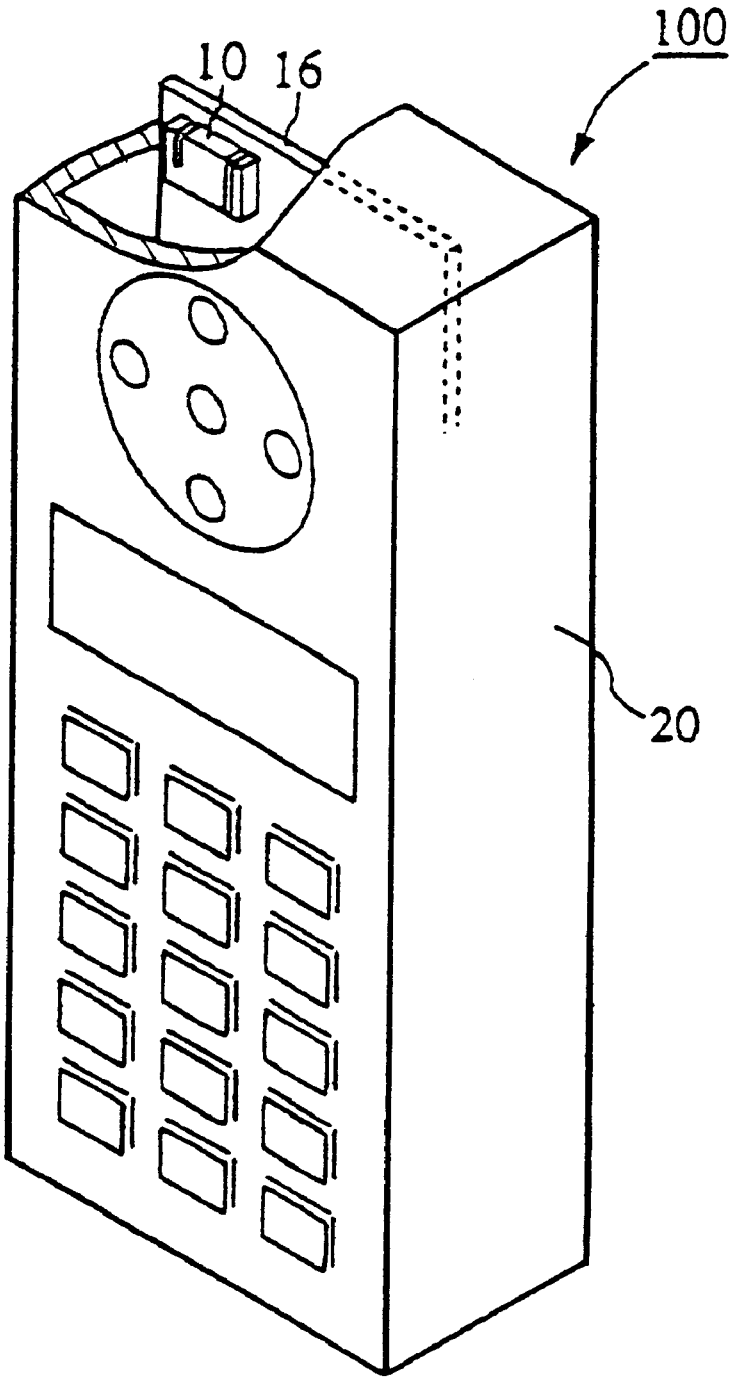
FIG. 3 is a partially fragmentary perspective view of a communication apparatus using the surface mount type antenna.

Other features and advantages of the present invention will become apparent from the following description of the invention which refers to the accompanying drawings.

DETAILED DESCRIPTION OF PREFERRED EMBODIMENTS OF THE INVENTION

A surface mount type antenna which represents a first embodiment of the present invention and a communication apparatus using the surface mount type antenna will be described with reference to FIGS. 1 to 3.

FIG. 1 is a perspective view of the surface mount type antenna of the first embodiment. A member 11 shown in the figure is a dielectric base made of a dielectric ceramic or a synthetic resin having a comparatively large dielectric constant. Electrodes 1*a* and 1*d* are formed on the upper surface (first main surface) of the dielectric base 11 as viewed in the figure, and electrodes 3*a*, 2*a*, and 1*c* are formed on the lower surface (second main surface) as viewed in the figure. Electrodes 2*b* and 3*b* are formed on the left front end surface of the dielectric base 11. An electrode 1*b* is formed on the right rear end surface of the dielectric base 11. In these electrodes, the electrodes 1*a*, 1*b*, 1*c*, and 1*d* function as a radiation electrode, the electrodes 2*a* and 2*b* function as a feed electrode, and the electrodes 3*a* and 3*b* function as a ground electrode. A resonance circuit is thus formed by the electrostatic capacitance produced between an end portion of the ground electrode 3*b* and end portions of the radiation electrode 1*c* and 1*d* and the inductance of the radiation electrode 1*a*, 1*b*, and 1*c*, and the radiation electrode and the feed electrode are coupled to each other by the electrostatic capacitance produced between the feed electrode 2*a*, 2*b* and end portions of the radiation electrode 1*c*, 1*d*.

FIG. 2 is an equivalent circuit diagram of the surface mount type antenna 10 shown in FIG. 1. Referring to FIG. 2, the surface mount type antenna is mainly formed of an inductance L, a resistor R, and capacitors C23, C21, and C13. In the structure with the configuration shown in FIG. 1, the inductor L corresponds to the self-inductance of the radiation electrode consisting of the electrodes 1*a*, 1*b*, 1*c*, and 1*d*, the capacitor C13 corresponds to the electrostatic capacitance formed between open-circuited ends of the radiation electrode (mainly an end portion of the electrode 1*d*) and the ground electrode 3*b*, the capacitor C21 corresponds to the electrostatic capacitance formed between the open-circuited ends of the radiation electrode (mainly an end portion of the electrode 1*c*) and the feed electrode 2*a*, 2*b*, and the capacitor C23 corresponds to the electrostatic capacitance formed between the feed electrode 2*a*, 2*b* and the ground electrode 3*b*. The resistor R represents the radiation resistance of the surface mount antenna.

In the equivalent circuit shown in FIG. 2, the resonance circuit is mainly formed of the inductor L, the resistor R and the capacitor C13. When a signal is input from a high-frequency signal source to the resonance circuit via the capacitor 21, resonance with energy of the signal occurs in the resonance circuit and a part of the resonance energy is radiated through the air. Thus, the circuit functions as an antenna. This radiated energy is expressed as an equivalent to the energy consumed in the resistor R.

FIG. 3 is a partially fragmentary perspective view of the configuration of a communication apparatus such as a portable telephone using the surface mount type antenna shown in FIG. 1. A member 16 shown in FIG. 3 is a circuit board, and the surface mount type antenna 10 shown in FIG. 1 is mounted in a surface mount manner on a first surface of the circuit board 16. No electrodes are formed on the first and second or reverse surfaces of the portion of the circuit board 16 on which the surface mount type antenna is mounted.

An end portion of electrode 1*c* of the radiation electrode is extended on the lower surface (second main surface) of the dielectric base 11 as viewed in FIG. 1 to increase the degree of coupling between the feed electrode 2*a*, 2*b* and the open-circuited ends of the radiation electrode (to increase the electrostatic capacity C21 shown in FIG. 2), thus facilitating impedance matching to an external circuit. Also, since a part of the radiation electrode is formed on the upper surface of the dielectric base, frequency adjustment by cutting a predetermined portion thereof can be performed with improved facility.

Figure 4A:
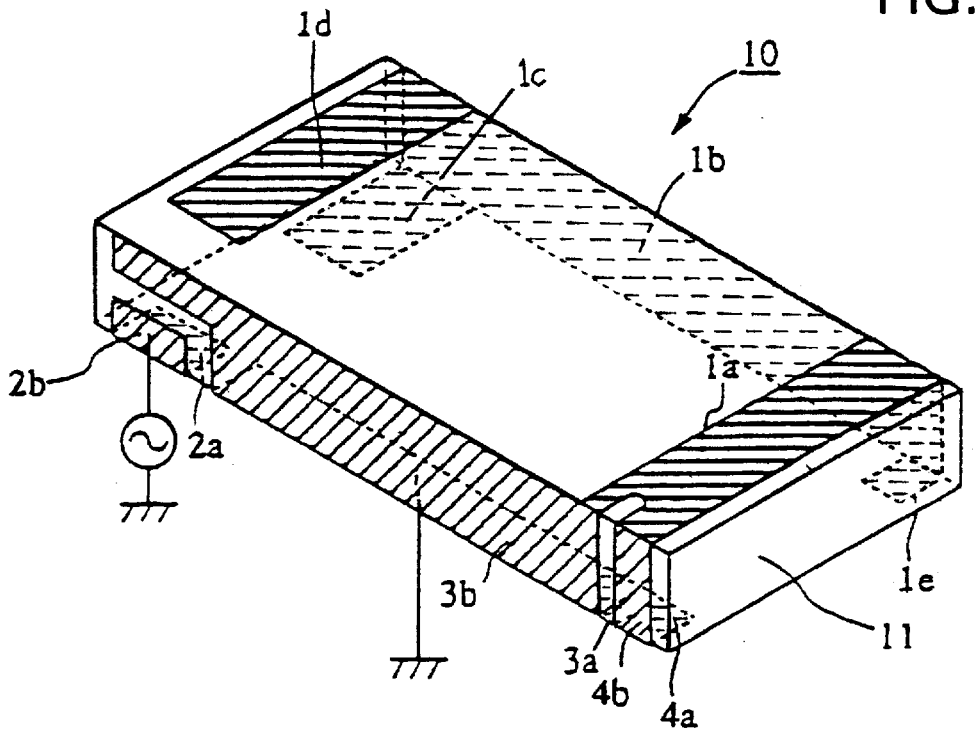
FIG. 4A comprises a perspective view of a surface mount type antenna which represents a second embodiment of the invention.

FIG. 4(A) is a perspective view of a surface mount type antenna which represents a second embodiment of the present invention. The structure of this surface mount type antenna differs from that shown in FIG. 1 in that portions of the grounding and radiation electrodes shown in FIG. 1 are cut to form an electrode 4*b*, and that an electrode 4*a*, which connects to the electrode 4*b*, is also formed on the lower surface of the dielectric base 11. The electrodes 4*a* and 4*b* function as a control electrode for changing the resonant frequency. In addition, an electrode 1*c* is provided on the lower surface of the base 11.

Figure 4B:
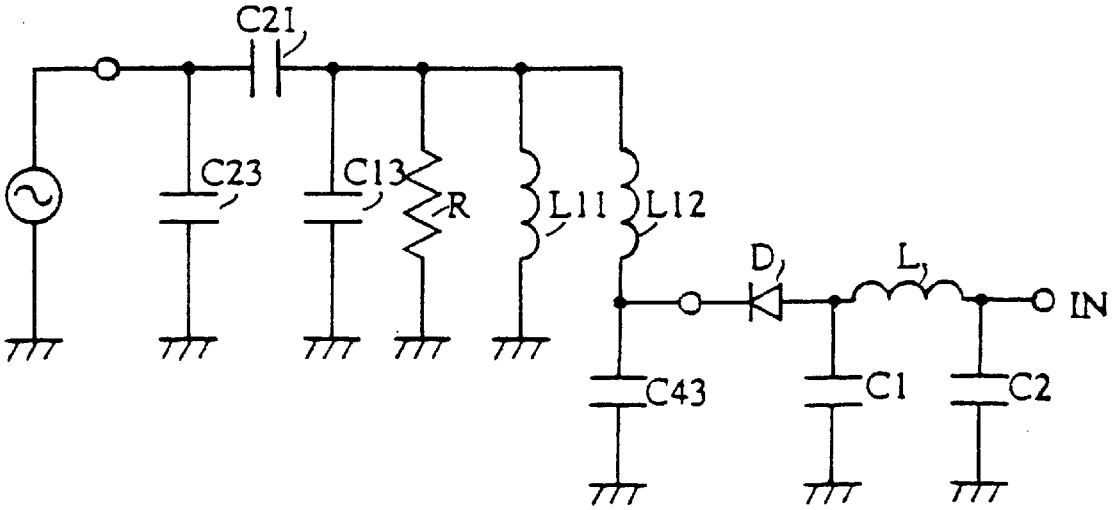
FIG. 4B is an overall equivalent circuit diagram including a resonant frequency changing circuit of the antenna of FIG. 4A.

FIG. 4(B) is an overall equivalent circuit diagram of the surface mount type antenna shown in FIG. 4(A) and a frequency changing circuit connected to the surface mount type antenna. In FIG. 4(B), L11 represents a main inductance component formed by the radiation electrodes 1*a*, 1*b*, 1*c*, and 1*d*; L12 represents an inductance component formed by the control electrode 4*a*, 4*b*; and C43 represents the electrostatic capacitance produced between the control electrode 4*a*, 4*b* and the ground electrode. Components D, C1, L, and C2 form a resonant frequency changing circuit. The configuration of other components C23, C21, C13, and R is the same as that shown in FIG. 2. In a state where no control signal is applied to a control terminal IN, resonance occurs at a frequency determined by the resonance circuit formed by C13 and L11. When a positive control voltage is applied to the control terminal IN, the diode D becomes conductive and one end of the inductance component L12 is grounded by the diode D and the capacitor C1. The inductance component of the resonance circuit formed of C13, L11, and L12 is thereby reduced. As a result, the resonant frequency is increased. The resonant frequency of the antenna is thereby increased. The components L and C2 of the resonant frequency changing circuit function as an RF choke circuit.

Figure 5A:
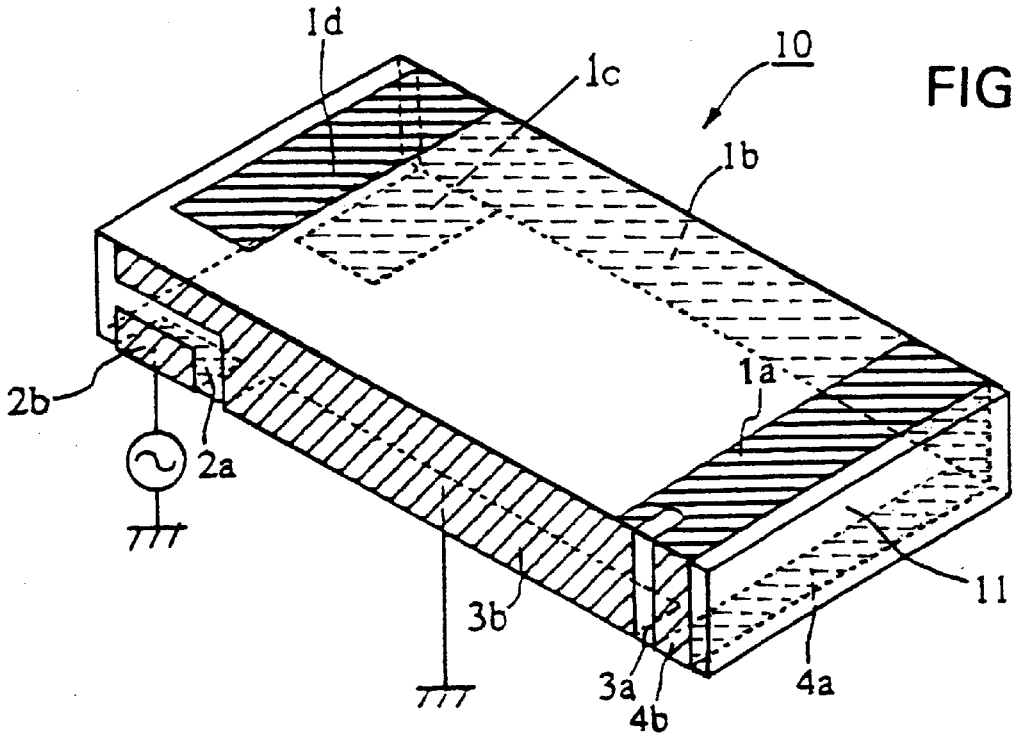
FIGS. 5A and 5B comprise perspective view of two surface mount type antennas in accordance with a third embodiment of the invention.
Figure 5B:
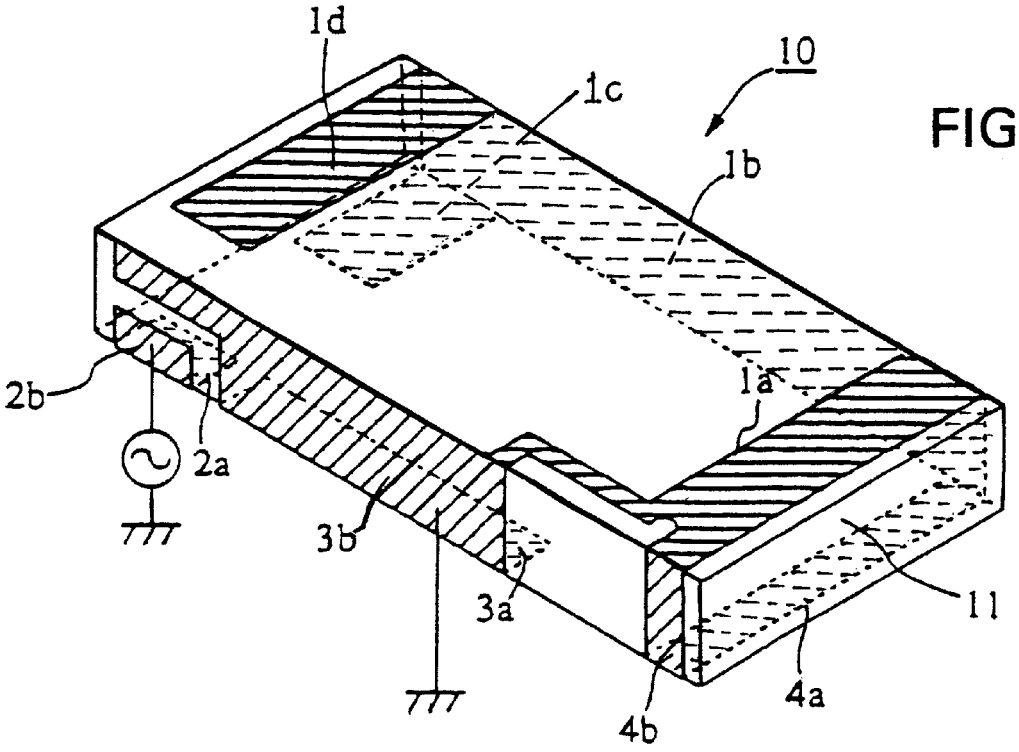

FIG. 5(A) and FIG. 5(B) are perspective views of two surface mount type antennas in accordance with a third embodiment of the present invention. The structure of the surface mount type antenna shown in FIG. 5(A) differs from the structure of the surface mount type antenna shown in FIG. 4(A) in that the electrode 4*a* is formed on the lower surface of the dielectric base so as to connect to the radiation electrode 1*b*. In this structure, the radiation electrode 1*a* and 1*b* and the control electrode 4*a* and 4*b* form a loop which functions as an electric wall and which is equivalent in function to a radiation electrode formed over the entire area of the right front end surface of the dielectric base 11 as viewed in the figure, thereby making it possible to increase the antenna gain. In the antenna shown in FIG. 5(B), which is a modification of the antenna shown in FIG. 5(A), the end of the radiation electrode 1*a* connected to the ground electrode is set a comparatively large distance apart, thereby making it possible to increase the amount of change (offset) in the resonant frequency.

Figure 6A:
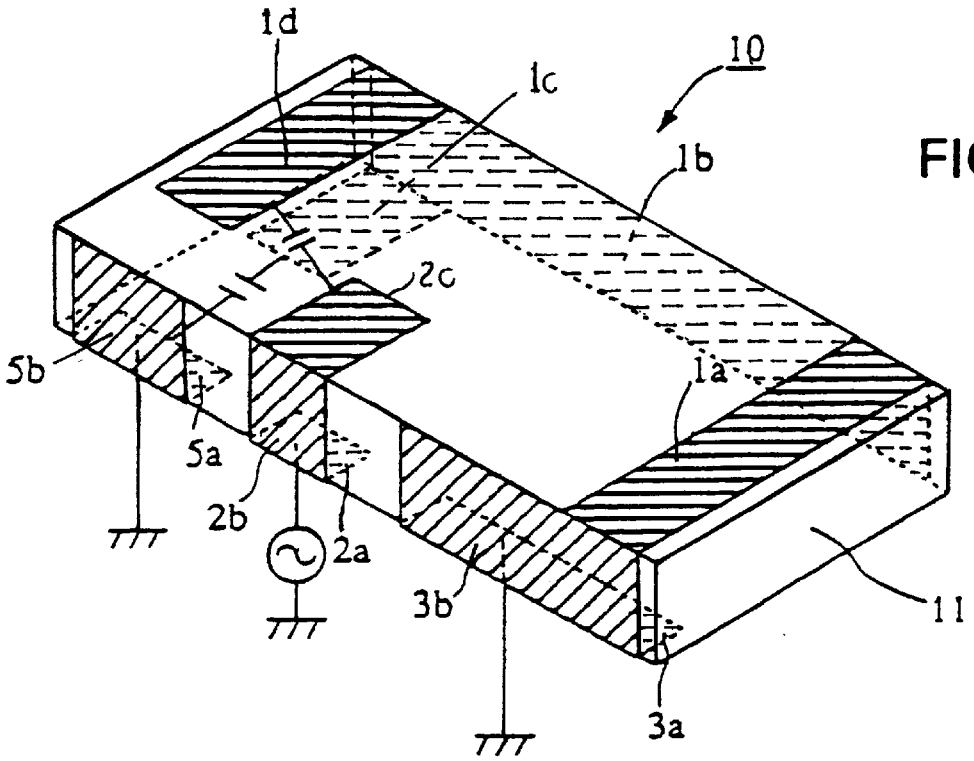
FIGS. 6A and 6B comprise perspective views of two surface mount type antennas in accordance with a fourth embodiment of the invention.
Figure 6B:
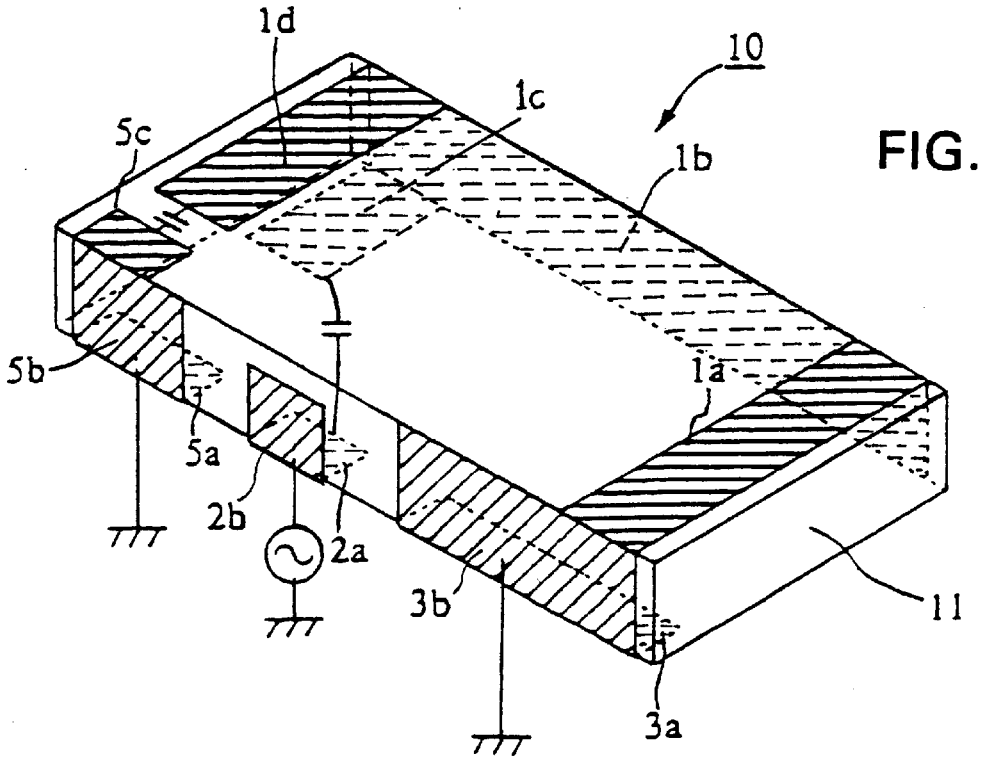
Figure 7:
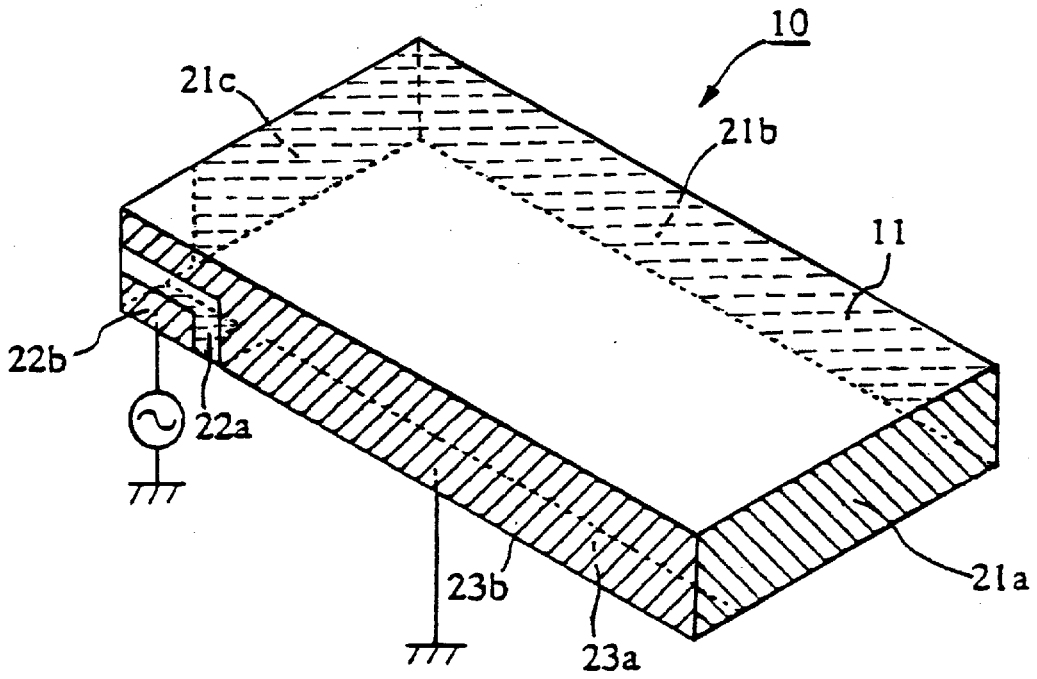
FIG. 7 PRIOR ART
FIG. 7 is a perspective view of the configuration of a prior art surface mount type antenna.
Figure 8:
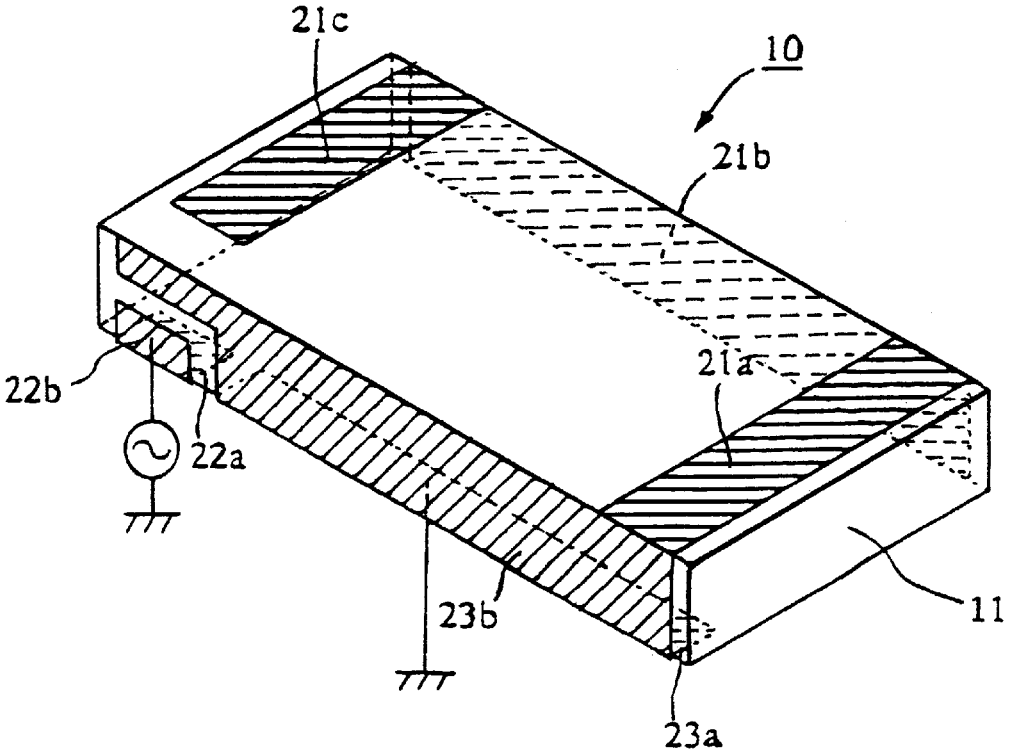
FIG. 8 PRIOR ART
FIG. 8 is a perspective view of the configuration of a modified form of the prior art surface mount type antenna.

FIG. 6(A) and FIG. 6(B) are perspective views of two surface mount type antennas in accordance with a fourth embodiment of the present invention. The surface mount type antenna of this embodiment differs from those of the first to third embodiments in that a ground electrode which forms an electrostatic capacitance with a radiation electrode open-circuited end is provided separately from a grounding end of the radiation electrode. That is, referring to FIG. 6(A), a radiation electrode indicated by 1*a*, 1*b*, 1*c*, and 1*d* is formed, which extends from a position on the upper surface to positions on the upper and lower surfaces via the right rear end surface of the dielectric base 11 as viewed in the figure; a ground electrode indicated by 3*a* and 3*b* is formed, which extends from a position on the sower surface to a position of the left front end surface of the dielectric base 11 as viewed in the figure; a feed electrode indicated by 2*a*, 2*b*, and 2*c* is formed, which extends from a position on the lower surface to a position on the upper surface via the left front end surface of the dielectric base 11 as viewed in the figure; and a ground electrode indicated by 5*a* and 5*b* is further formed, which extends from a position on the lower surface to a position on the left front end surface. In this structure, an electrostatic capacitance for coupling is produced between the feed electrode (mainly 2*c*) and the radiation electrode open-circuited ends (mainly 1*d*) while an electrostatic capacitance for the resonance circuit is produced between the radiation electrode open-circuited ends (mainly 1*c*) and the ground electrode 5*a*, 5*b*.

Referring to FIG. 6(B), a radiation electrode indicated by 1*a*, 1*b*, 1*c*, and 1*d* is formed, which extends from a position on the upper surface to positions on the upper and lower surfaces via the right rear end surface of the dielectric base 11 as viewed in the figure; a ground electrode indicated by 3*a* and 3*b* is formed, which extends from a position on the lower surface to a position on the left front end surface of the dielectric base 11 as viewed in the figure; a feed electrode indicated by 2*a* and 2*b* is formed, which extends from a position on the lower surface to a position on the left front end surface of the dielectric base 11 as viewed in the figure; and a ground electrode indicated by 5*a*, 5*b*, and 5*c* is further formed, which extends from a position on the lower surface to a position on the upper surface via the left front end surface. In this structure, an electrostatic capacitance for coupling is produced between the feed electrode (mainly 2*a*) and the radiation electrode open-circuited ends (mainly 1*c*) while an electrostatic capacitance for the resonance circuit is produced between the radiation electrode open-circuited ends (mainly 1*d*) and the ground electrode (mainly 5*c*).

While a dielectric base is used in the abovedescribed embodiments, a dielectric magnetic material may also be used. In such a case, if the material used has a high permeability, the impedance of the electrodes is increased and, accordingly, Q is suitably reduced, so that a wide-frequency-band characteristic can be obtained.

Although the invention has been described in relation to particular embodiments thereof, many other variations and modifications and other uses will become apparent to those skilled in the art. The invention, therefore, should be limited not by the specific disclosure herein, but only by the appended claims.

What is claimed is:

1. A surface mount type antenna, comprising at least one of a dielectric base and a magnetic base having first and second main surfaces opposite from each other and side surfaces substantially perpendicular to said main surfaces, a feed electrode disposed on said base, a ground electrode disposed on said base, and a radiation electrode disposed on said base and having a short-circuited end connected to said ground electrode and an open-circuited end capacitively coupled to said feed electrode by extending said radiation electrode onto both of said first and second main surfaces and further wherein said radiation electrode has at least two short-circuited ends.

2. The surface mount type antenna according to claim 1, wherein at least one of said short-circuited ends is selectively connected or disconnected to ground by a resonant frequency control changing circuit.

3. The surface mount type antenna according to claim 2, wherein at least a part of said radiation electrode has a loop shape connected to one of said short-circuited ends.

4. The surface mount type antenna according to claim 1, wherein at least a part of said radiation electrode has a loop shape connected to one of said short-circuited ends.

5. The surface mount type antenna according to claim 1, wherein at least one of said short circuited ends connected to one of said main surfaces connected to said ground electrode.

6. The surface mount type antenna according to claim 1, further comprising a further ground electrode disposed on said base, said feed electrode being disposed between said ground electrode and the further ground electrode, a capacitive coupling being established between the further ground electrode and the radiation electrode.

7. A surface mount type antenna, comprising at least one of a dielectric base and a magnetic base having first and second main surfaces opposite from each other and side surfaces substantially perpendicular to said main surfaces, a feed electrode disposed on said base, a ground electrode disposed on said base, and a radiation electrode disposed on said base and having a short-circuited end connected to said ground electrode and an open-circuited end capacitively coupled to said feed electrode by extending said radiation electrode onto both of said first and second main surfaces and further; wherein said short circuited end connected to said ground electrode is slotted so as to change a resonant frequency of the surface mount type antenna.

8. A surface mount type antenna, comprising at least one of a dielectric base and a magnetic base having first and second main surfaces opposite from each other and side surfaces substantially perpendicular to said main surfaces, a feed electrode disposed on said base, a ground electrode disposed on said base, and a radiation electrode disposed on said base and having a short-circuited end connected to said ground electrode and an open-circuited end capacitively coupled to said feed electrode by extending said radiation electrode onto both of said first and second main surfaces;

further comprising a further ground electrode disposed on said base, said feed electrode being disposed between said ground electrode and the further ground electrode, a capacitive coupling being established between the further ground electrode and the radiation electrode;

further wherein the further ground electrode extends onto said first main surface, a capacitive coupling being formed between an extension of said further ground electrode on the first main surface and the radiation electrode.

9. A communication apparatus comprising a circuit board having electrodes thereon and a surface mount type antenna mounted on the circuit board and connected to said electrodes, the surface mount antenna comprising at least one of a dielectric base and a magnetic base having first and second main surfaces opposite from each other and side surfaces substantially perpendicular to said main surfaces, a feed electrode disposed on said base, a ground electrode disposed on said base, and a radiation electrode disposed on said base and having a short-circuited end connected to said ground electrode and an open-circuited end capacitively coupled to said feed electrode by extending said radiation electrode onto both of said first and second main surfaces and further wherein said radiation electrode has at least two short-circuited ends.

10. The communication apparatus according to claim 9, and further wherein at least one of said short-circuited ends is selectively connected or disconnected to ground by a resonant frequency control changing circuit.

11. The communication apparatus according to claim 10, and further wherein at least a part of said radiation electrode has a loop shape connected to one of said short-circuited ends.

12. The communication apparatus according to claim 9, and further wherein at least a part of said radiation electrode has a loop shape connected to one of said short-circuited ends.

13. The communication apparatus according to claim 9, and further wherein at least one of said short circuited ends connected to said ground electrode is provided as an extending line on one of said main surfaces connected to said ground electrode, and further comprising a further ground electrode disposed on said base, said feed electrode being disposed between said ground electrode and the further ground electrode, a capacitive coupling being established between the further ground electrode and the radiation electrode.

14. The communication apparatus according to claim 9, and further comprising a further ground electrode disposed on said base, said feed electrode being disposed between said ground electrode and the further ground electrode, a capacitive coupling being established between the further ground electrode and the radiation electrode.

15. A communication apparatus comprising a circuit board having electrodes thereon and a surface mount type antenna mounted on the circuit board and connected to said electrodes, the surface mount antenna comprising at least one of a dielectric base and a magnetic base having first and second main surfaces opposite from each other and side surfaces substantially perpendicular to said main surfaces, a feed electrode disposed on said base, a ground electrode disposed on said base, and a radiation electrode disposed on said base and having a short-circuited end connected to said ground electrode and an open-circuited end capacitively coupled to said feed electrode by extending said radiation electrode onto both of said first and second main surfaces and further wherein said short circuited end connected to said ground electrode is slotted so as to change a resonant frequency of the surface mount type antenna.

16. A surface mount type antenna, comprising at least one of a dielectric base and a magnetic base having first and second main surfaces opposite from each other and side surfaces substantially perpendicular to said main surfaces, a feed electrode disposed on said base, a ground electrode disposed on said base, and a radiation electrode disposed on said base and having a short-circuited end connected to said ground electrode and an open-circuited end capacitively coupled to said feed electrode by extending said radiation electrode onto both of said first and second main surfaces;

and further comprising a further ground electrode disposed on said base, said feed electrode being disposed between said around electrode and the further around electrode, a capacitive coupling being established between the further ground electrode and the radiation electrode; and further wherein the further ground electrode extends onto said first main surface, a capacitive coupling being formed between an extension of said further ground electrode on the first main surface and the radiation electrode.

* * * * *